US008918199B2

(12) United States Patent
Claveroulas et al.

(10) Patent No.: US 8,918,199 B2
(45) Date of Patent: Dec. 23, 2014

(54) METHOD AND SECTION FOR COOLING A MOVING METAL BELT BY SPRAYING LIQUID

(75) Inventors: Cyril Claveroulas, Baulne (FR); Frederic Marmonier, Vaucresson (FR)

(73) Assignee: Fives Stein (FR)

( * ) Notice: Subject to any disclaimer, the term of this patent is extended or adjusted under 35 U.S.C. 154(b) by 511 days.

(21) Appl. No.: 13/143,007

(22) PCT Filed: Jan. 7, 2010

(86) PCT No.: PCT/IB2010/050049

§ 371 (c)(1),
(2), (4) Date: Jun. 30, 2011

(87) PCT Pub. No.: WO2010/079452

PCT Pub. Date: Jul. 15, 2010

(65) Prior Publication Data

US 2011/0270433 A1 Nov. 3, 2011

(30) Foreign Application Priority Data

Jan. 9, 2009 (FR) ..... 09 00077

(51) Int. Cl.

| | |
|---|---|
| ***G05D 23/19*** | (2006.01) |
| ***C21D 11/00*** | (2006.01) |
| ***C21D 9/573*** | (2006.01) |
| ***C21D 9/56*** | (2006.01) |
| ***C21D 1/667*** | (2006.01) |

(52) U.S. Cl.

CPC ..... *C21D 9/573* (2013.01); *C21D 11/005* (2013.01); *C21D 9/56* (2013.01); *C21D 1/667* (2013.01)

USPC ..... 700/153; 700/147

(58) Field of Classification Search

CPC ..... B21B 1/04

USPC ..... 700/146, 147, 153; 148/660

See application file for complete search history.

(56) References Cited

U.S. PATENT DOCUMENTS

2002/0020513 A1* 2/2002 Pleschiutschnigg et al. . 164/455
2010/0132426 A1* 6/2010 Baumgartel et al. ..... 72/342.2

(Continued)

FOREIGN PATENT DOCUMENTS

EP 0111985 A2 6/1984
EP 0921208 A2 6/1999

(Continued)

OTHER PUBLICATIONS

JP 2003-185501 to Tatsuro et al., Japan Jul. 2003 (English translation appended to the end of Japanese Publication Document JP 2003-185501.*

(Continued)

*Primary Examiner* — Carlos Ortiz Rodriguez
*Assistant Examiner* — Emilio J Saavedra
(74) *Attorney, Agent, or Firm* — The Belles Group, P.C.

(57) ABSTRACT

The invention relates to a method for monitoring the cooling of a moving metal belt (B) in a cooling section of a continuous processing line by spraying a liquid or a mixture consisting of a gas and a liquid onto the belt, the cooling depending on parameters including the temperature, speed, and current characteristics of a cooling liquid, wherein according to said method: one or more areas are determined in which cooling parameters are such that the local removal of a vapor film on the surface of the hot belt is carried out or capable being carried out, leading to the redampening of the belt; and at least the temperature of the cooling liquid is adjusted as a cooling parameter in the thus-determined area(s) so as to maintain, or return to, a cooling into a vapor film on the surface of the belt.

12 Claims, 4 Drawing Sheets

(56) References Cited

U.S. PATENT DOCUMENTS

| | | | | |
|---|---|---|---|---|
| 2010/0192658 | A1* | 8/2010 | Ueoka et al. | 72/342.5 |
| 2011/0208345 | A1* | 8/2011 | Soderlund | 700/153 |

FOREIGN PATENT DOCUMENTS

| | | | |
|---|---|---|---|
| JP | 57120623 | A | 7/1982 |
| JP | 57-041317 | | 8/1982 |
| JP | 58071339 | A | 4/1983 |
| JP | 59-059835 | | 4/1984 |
| JP | 59157228 | A | 9/1984 |
| JP | 63-1256222 | | 5/1986 |
| JP | 63-1256222 | | 5/1988 |
| JP | 63125622 | A | 5/1988 |
| JP | 06-256858 | | 9/1994 |
| JP | 11090521 | A | 4/1999 |
| JP | 11309507 | A | 11/1999 |
| JP | 2000-178658 | | 6/2000 |
| JP | 2000178658 | A | 6/2000 |
| JP | 2003185501 | A | 7/2003 |
| JP | 2009-127060 | | 6/2009 |
| RU | 2144205 | C1 | 1/2000 |
| RU | 2229922 | C2 | 6/2004 |
| RU | 2003121296 | A | 1/2005 |
| SU | 531579 | | 10/1976 |
| SU | 1765197 | | 9/1992 |
| WO | 97/01807 | | 1/1997 |
| WO | 00/40338 | | 7/2000 |
| WO | 02/48411 | | 6/2002 |

OTHER PUBLICATIONS

Sengupta et al., "The Use of Water Cooling during the Continuous Casting of Steel and Aluminum Alloys" Metallurgical and Materials Transactions., vol. 36A, Jan. 2005. pp. 187-204.*

* cited by examiner

METHOD AND SECTION FOR COOLING A MOVING METAL BELT BY SPRAYING LIQUID

CROSS REFERENCE TO RELATED APPLICATIONS

This application is a National Phase filing under 35 U.S.C. §371 of PCT/ib2010/050049 filed on Jan. 7, 2010; and this application claims priority to Application No. 0900077 filed in France on Jan. 9, 2009 under 35 U.S.C. §119; the entire contents of all are hereby incorporated by reference.

BACKGROUND

The present invention relates to improvements made to the cooling sections of lines for the continuous processing of metal strip, in particular annealed, galvanized or tin strip.

A line for the continuous processing of metal strip consists of a succession of thermal processing stations, in particular sections for heating, maintaining temperature, cooling, ageing etc.

The present invention relates to the cooling sections of continuous processing lines and more particularly sections for rapid cooling with the spraying of a liquid onto the strip.

The cooling liquid is generally water, which may be treated in advance, for example so as to extract the dissolved oxygen or the mineral salts therefrom, and which may contain additives for improving the thermal exchange or limiting the oxidation of the strip.

Cooling using water makes it possible to obtain very high cooling slopes, higher than those which may be obtained with gaseous cooling.

The cooling of the strip can also be obtained by spraying the strip with a mixture consisting of a gas and a liquid. In this case, the gas is generally present as a carrier gas for effecting the atomization and the spraying of the liquid onto the strip. The gas used is usually nitrogen but can also consist of a mixture of nitrogen and hydrogen, or any other gas.

The liquid may be sprayed in the form of a mist or atomized with larger-sized droplets or in the form of a continuous liquid.

In the thermal cycle that is effected, the cooling of the strip can then begin when the strip is at a high temperature, for example 750° C. When the strip is at a temperature that is much higher than the boiling temperature of the cooling liquid, a film boiling or vapor film situation occurs. This phenomenon is called calefaction. The layer of vapor causes something of a barrier to the transfer of heat between the strip and the water, thus reducing the effectiveness of the cooling with water.

For the example of water, the boiling temperature is close to 100° C. It can vary by a few degrees depending on the composition of the water and the quantity of additives in it.

In sum, in the situation of a vapor film (film boiling), the problem can be reduced to cooling an imaginary wall to 100° C. using water. The temperature of the atomized water is then a first-order parameter for controlling the intensity of the cooling, □=h (100° C.−T water ° C.).

In terms of the calefaction phenomenon, there is a critical temperature for the strip, known as the "Lindenfrost temperature". For a temperature above this critical temperature, the cooling takes place with a vapor film and hence the cooling is ineffective but relatively very homogeneous. For a lower value of the temperature close to the critical temperature, the effectiveness of the cooling is significantly better but rather chaotic. In this case, there is a localized disappearance of the layer of vapor (the term "redampening" is then used), with a very high increase in the heat transfer. A steep temperature gradient results over the width of the strip, which can give rise to plastic deformations of the strip, for example the appearance of folds, or to heterogeneous mechanical properties over the width of the strip.

This critical temperature is dependent on numerous parameters, including the characteristics of the atomization, the temperature of the atomized liquid or the nature and temperature of the cooled surface.

The main factor is the effect on this temperature of the temperature of the cooling liquid and of the atomization parameters, ie the velocity and diameter of the droplets.

The object of the invention is especially to effect a homogeneous cooling of the metal strip, in particular to prevent the formation of folds or substantial differences in mechanical characteristics over the width and/or length.

SUMMARY OF THE INVENTION

According to the invention, a method for controlling the cooling of a moving metal strip in a cooling section of a continuous processing line which sprays onto the strip a liquid or a mixture consisting of a gas and a liquid, the cooling being dependent on parameters including the temperature, velocity and characteristics of the stream of cooling fluid, is characterized in that:

- one or more zones are determined in which the parameters of the cooling are such that the localized disappearance of a vapor film could or does occur at the surface of the hot strip, causing a redampening of the strip,
- and, as a cooling parameter in the zone or zones so determined, at least the temperature of the cooling liquid is adjusted, which temperature is increased in the zone where a redampening could occur, or where it does occur, so as to maintain or restore cooling with a vapor film at the surface of the strip, resulting from the calefaction phenomenon of the cooling liquid in contact with the hot strip.

The invention is thus primarily a method for controlling the cooling of a moving metal strip in a continuous processing line which sprays onto the strip a liquid or a mixture consisting of a gas and a liquid, so as to maintain cooling "with a vapor film" at the surface of the strip, resulting from the calefaction phenomenon of the cooling liquid in contact with a hot strip, consisting in increasing the temperature of the cooling liquid in the zone where a redampening could occur, or where it does occur, resulting from the localized disappearance of the vapor film, so as to preserve or restore cooling with a vapor film at the surface of the strip.

Advantageously, another adjusted cooling parameter consists in an atomization parameter formed by the velocity and/or the diameter of the droplets of cooling liquid in the relevant zone or zones.

When the cooling method employs a cooling section having a plurality of successive cooling units arranged in the direction in which the strip moves, the temperature of the cooling liquid can be adjusted such that it differs between two successive cooling units of the cooling section.

Combined adjustment of the temperature and the flow rate of the cooling liquid can be carried out so as to enable the heat flow extracted from the strip to be modulated.

The temperature of the cooling liquid can be adjusted over the width of the strip. Multiple units for spraying the cooling fluid can be distributed over the width of the strip, and the temperature and flow rate of the cooling liquid for each spraying unit are adjusted over the width of the strip.

The temperature of the liquid can be adjusted at the beginning of the cooling so as to limit the variation in the temperature slope resulting from cooling, compared with heating or compared with maintaining the preceding temperature.

The temperature of the liquid can be adjusted according to the target cooling capacity so as to limit the variations in the flow rate of the cooling liquid.

Advantageously, in order to determine one or more zones in the cooling section in which the parameters of the cooling are such that localized disappearance of a vapor film could occur, or does occur, at the surface of the hot strip, causing a redampening of the strip, during prior tests, the operating conditions are varied, it is observed when the redampening of the strip occurs and in which cooling section, and, all other operating conditions being unaltered, the temperature of the liquid is gradually raised in the zone where the redampening occurs so as to be able to define the liquid temperature required to eliminate the redampening and restore a situation where there is a vapor film in the zone under study.

The tests can be repeated in a following zone, in the direction in which the strip moves, so as to preserve a vapor film throughout the cooling section or, when that is not possible, to defer the beginning of the redampening to a lower temperature.

Advantageously, in order to define the point in time at which the redampening occurs and the zone in which it occurs, the appearance of a steep increase in the transverse temperature gradient of the strip, and of a significant discontinuity in the cooling slope resulting from the more intense cooling with no film vapor present, is determined with the aid of devices for measuring the temperature of the strip in the zones where the redampening is likely to occur.

The tests are preferably carried out in a zone situated along the edge of the metal strip where the temperature of the strip is between 450° C. and 250° C., and at several points over the width of the strip so as to detect large variations in temperature.

The invention also relates to a cooling section of a continuous processing line for implementing the above-defined method, which section has units for spraying a metal strip with a liquid or a mixture consisting of a gas and a liquid, and is characterized in that it has, for at least one unit for spraying cooling liquid onto the strip, a system for supplying cooling liquid which comprises two separate circuits for supplying cold water and hot water, each being equipped with a regulating valve and connected to a same outlet duct, a controller for the flow rate of the mixture being provided on the outlet duct, as well as a controller for the temperature of the mixture.

The supply system can have a regulator which makes it possible to adjust the proportion of the flow rates of cold water and hot water so as to obtain the overall target flow rate of the liquid at the desired temperature, and this is the case for each spraying device.

According to the invention, the temperature of the cooling liquid can be regulated as a function of the desired thermal flow and as a function of the temperature of the strip.

Thus, just after the beginning of the cooling with, for example, a strip temperature of 700° C., cold water which may even be close to 0° C. is sprayed but when the strip reaches lower temperatures, for example 450° C., the water must be hotter so as to maintain the vapor film situation (film boiling).

With hotter water at the end of the cooling (for example 35° C. at the beginning of the cooling and 80° C. at the end of the cooling), the invention makes it possible to maintain control of the cooling while preserving a vapor film for longer. This controlling of the temperature of the water, which may be combined with an adjustment of the flow rate of water over the width of the strip, makes it possible to obtain a homogeneous strip temperature over its width.

Determination by calculating the Lindenfrost temperature is very difficult as many parameters affect the latter. The atomization parameters are very important. Thus, the size of the droplets, the distance between the droplets, the velocity of the droplets, the atomization temperature of the liquid, the proportion and the temperature of the atomizing gas affect the Lindenfrost temperature. It is also affected by the temperature, surface roughness and emissivity of the strip. The flow of heat exchanged by the strip is also a decisive factor. In fact, the Lindenfrost temperature depends on the speed with which the droplet of liquid reaches its vaporization temperature. The quicker this happens, the lower the Lindenfrost temperature.

Owing to the complexity of the phenomenon, determining the critical temperature, or Lindenfrost temperature, is mainly a matter of experimentation, ideally directly on the plant when it is installed.

In the tests, different means are possible for defining the point in time at which the redampening occurs and the zone in which it occurs.

The appearance of the redampening leads to a sharp increase in the transverse temperature gradient of the strip and to a significant discontinuity in the cooling slope resulting from the more intense cooling with no vapor film present. The most simple method consists in placing devices for measuring the temperature of the strip in the zones where the redampening is likely to occur, for example along the edge where the temperature of the strip is between 450° C. and 250° C. and at several points over the width of the strip so as to detect these large variations in temperature.

Tables can be drawn up from these tests, stating, for each type of production on the line, the temperature of the cooling liquid required in each zone to prevent or delay the redampening of the strip.

These tables are then integrated into the control and command system of the plant so as to automatically take into account for each zone the appropriate reference temperature of the cooling liquid for the type of production on the line.

As explained above, the large number of parameters which affect the redampening of the strip means that such redampening occurs during normal production of the line in an unexpected zone. According to the invention, the temperature of the cooling liquid is increased by the operator in the zone in question, so as to defer the redampening until the following zone. Depending on the zone where this redampening occurs, the operator can in advance also increase the temperature of the cooling water in the following zone or zones in order to further defer the beginning of the redampening. The rise in the temperature to be applied will have been defined beforehand during the installation tests, for example by 5° C. It can also be adjusted by the operator.

The increase in the temperature of the cooling liquid in a zone may be accompanied by another adjustment of the atomization parameters so as to maintain the target temperature slope on the strip without reducing the speed of the line. For example, the flow rate of the cooling water can be increased in this zone. The increase in the flow rate of the water can be effected automatically by the control and command system of the line so as to reach the reference temperature of the strip when it exits the cooling zone. Again, the optimum settings will have been defined when the line is installed or by trial and error during operation.

The above description of the invention corresponds to the adjustment of the temperature of the cooling liquid so as to preserve the vapor film mode. Another means for obtaining this result, at a constant liquid temperature, consists in modifying the size of the droplets and the velocity at which they strike the strip.

In the case where the cooling liquid is atomized with a gas, the velocity and the diameter of the droplets will be adjusted by modifying the proportion of the gas.

In the case where the liquid is atomized without gas, the velocity and the diameter of the droplets will be adjusted by mechanically modifying the nozzle at the orifice for atomizing the liquid.

The same mode of operation as described above for optimizing the temperature of the cooling liquid is used to determine the atomization parameters experimentally using tests.

It will easily be understood that it is possible to combine a variation of the temperature of the cooling liquid and of the atomization parameters so as to preserve the vapor film mode.

According to the method of the invention, the temperature of the cooling liquid and the atomization parameters, ie the velocity and diameter of the droplets, can be adjusted in the zone where a redampening could occur or does occur, resulting from the localized disappearance of the vapor film so as to preserve or restore cooling with a vapor film at the surface of the strip.

On plants for cooling using the spraying of water, the main parameter for controlling the cooling is generally the density of the flow rate of water, expressed in $kg/m^2/s$. When a gas is used as the spraying medium, it is not essential to regulate the flow rate of gas. According to the spraying device, the flow rate of gas naturally matches the flow rate of water. According to another example, the flow rate of gas remains constant.

BRIEF DESCRIPTION OF THE DRAWINGS

Apart from the arrangements explained above, the invention consists of a certain number of other arrangements which will be dealt with more explicitly below with the aid of exemplary embodiments described with reference to the attached drawings, which imply no limitation, in which.

DETAILED DESCRIPTION

Figure 1:
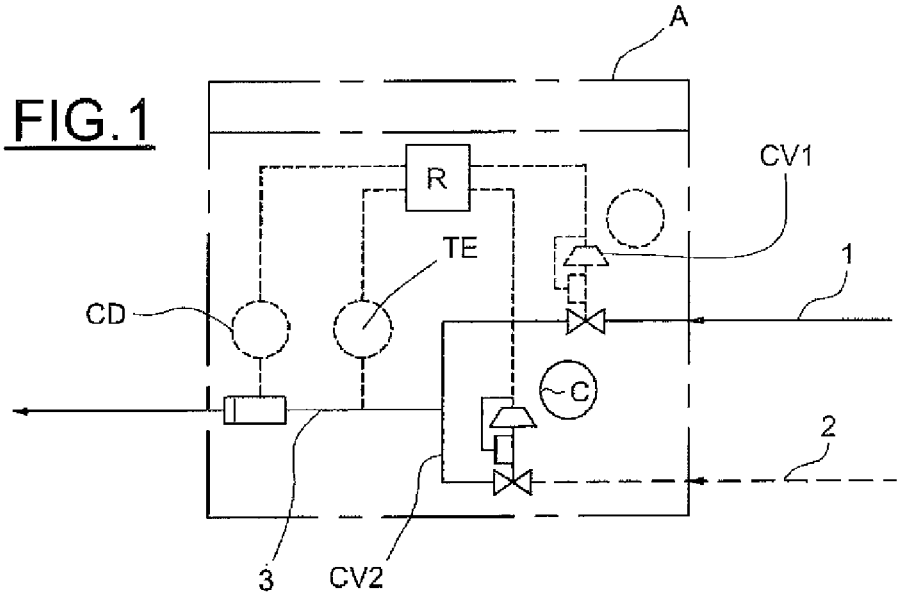
FIG. 1 is a diagram of a configuration according to the invention for supplying a unit for spraying cooling liquid.

FIG. 1 is a diagram of an exemplary embodiment of a system A for supplying cooling liquid according to the invention for a unit DI . . . DIII (FIG. 2) for spraying liquid onto a strip B to be cooled moving vertically downwards. Each unit DI . . . DIII is associated with a system A.

Figure 2:
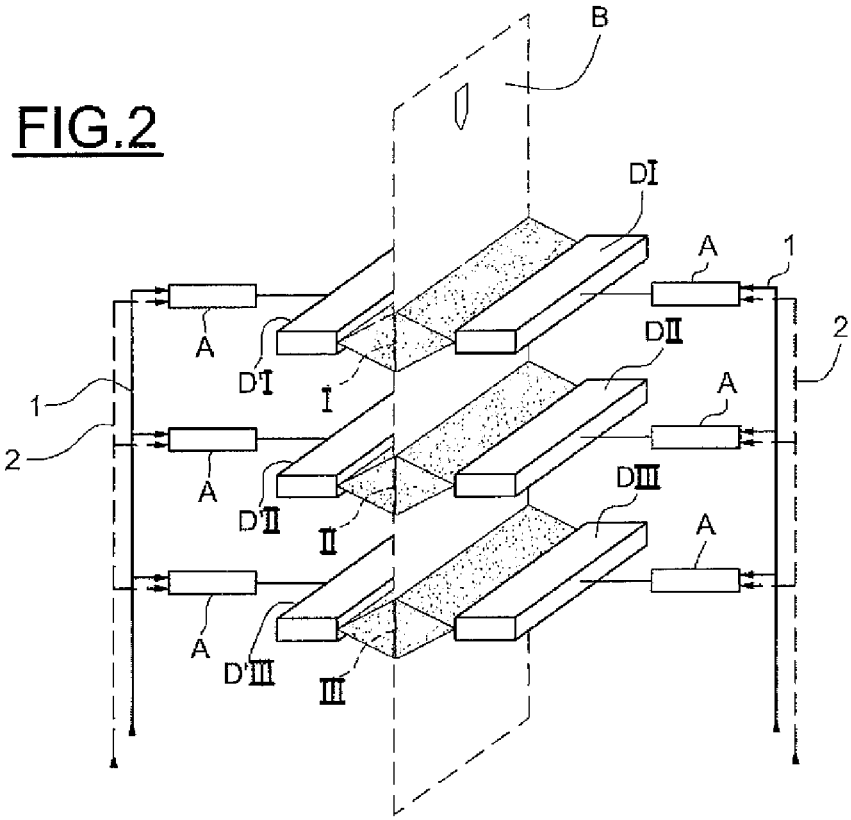
FIG. 2 is a perspective diagram in elevation of a cooling section according to the invention.

The system A controls the flow rate and temperature of the cooling water. The configuration of A comprises two separate circuits for supplying cold water 1 and hot water 2, each equipped with a regulating valve CV1, CV2 respectively and connected to a same outlet duct 3. A flow rate controller CD for the mixture is provided on the duct 3, as is a temperature controller TE for the mixture. A regulator R allows the proportion of the flow rates of the cold water and hot water to be adjusted so as to obtain the overall target flow rate of the liquid at the desired temperature, and to do so for each spraying unit, also called a cooling unit DI, DII, DIII (FIG. 2).

In FIGS. 2 to 5, the droplets of liquid atomized by each cooling unit are shown as a whole in the form of a prismatic sheet, the base of which is situated on the strip B, whereas the opposite edge corresponds to the liquid outlet nozzles of the cooling unit.

Controlling the temperature of the atomized water and/or controlling the atomization parameters according to the invention constitute additional means for controlling the flow rate of atomized water. These means make the cooling more flexible and more homogeneous.

According to the invention, the temperature of the cooling liquid and/or the atomization parameters are adjusted such that they differ between two successive cooling units DI, DII, DIII (FIG. 2) in the direction in which the strip moves.

The device according to the invention makes it possible to control the temperature of the atomized water and/or the atomization parameters over the length of the cooling section by splitting up the cooling device lengthwise into cooling zones I, II, III (FIG. 2). For each zone, a cooling unit is provided on each side of the strip, DI, D'I, . . . DIII, D'III respectively. Each cooling unit has a means for regulating the temperature of the liquid and/or a separate nozzle of the ejector from that of the other zones.

Figure 3:
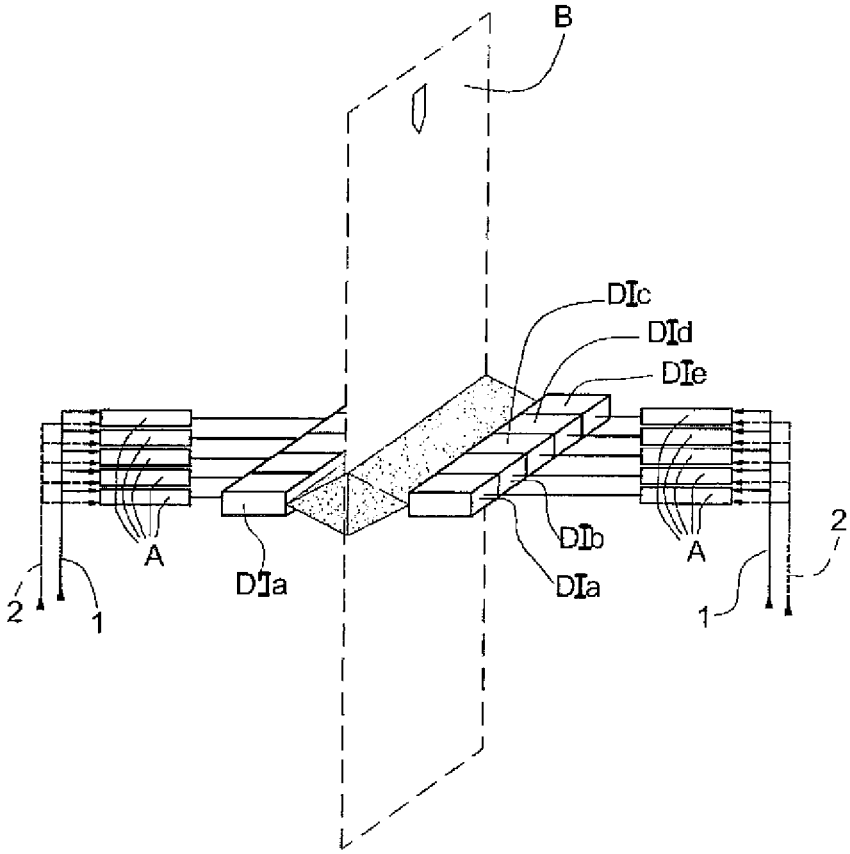
FIG. 3 is a diagram, similar to FIG. 2, of an alternative embodiment with cooling units spread over the width of the strip.

The device according to the invention also allows the temperature of the atomized water to be controlled over the width of the cooling section by, as illustrated in FIG. 3, splitting up the cooling device widthwise into split-up cooling units DIa, DIb, . . . DIe, each having a means for regulating the temperature of the liquid which is separate from that of the other zones.

According to an exemplary embodiment of the invention, the temperature-regulating means forming the system A is a hot water/cold water mixer faucet supplied from a hot water network and a cold water network. The mixer faucet adjusts the proportion of the flow rates of cold water and hot water in accordance with the reference temperature.

According to another exemplary embodiment of the invention, the temperature-regulating means is a heat exchanger between the cooling liquid and another fluid, for example air or water.

It is also possible to control the temperature of the atomized water and/or the atomization parameters transversely in order to act on the thermal homogeneity over the width of the strip. The temperature of the cooling liquid and/or the atomization parameters are thus adjusted over the width of the strip, for example for a constant flow rate of the liquid, so as to maintain a vapor film over the entire width of the strip and to control the level of heat exchange.

FIG. 3 is a diagram of an exemplary embodiment according to the invention of this transverse regulation of the temperature of the cooling liquid, with 5 separate cooling units over the width of the strip.

Figure 4:
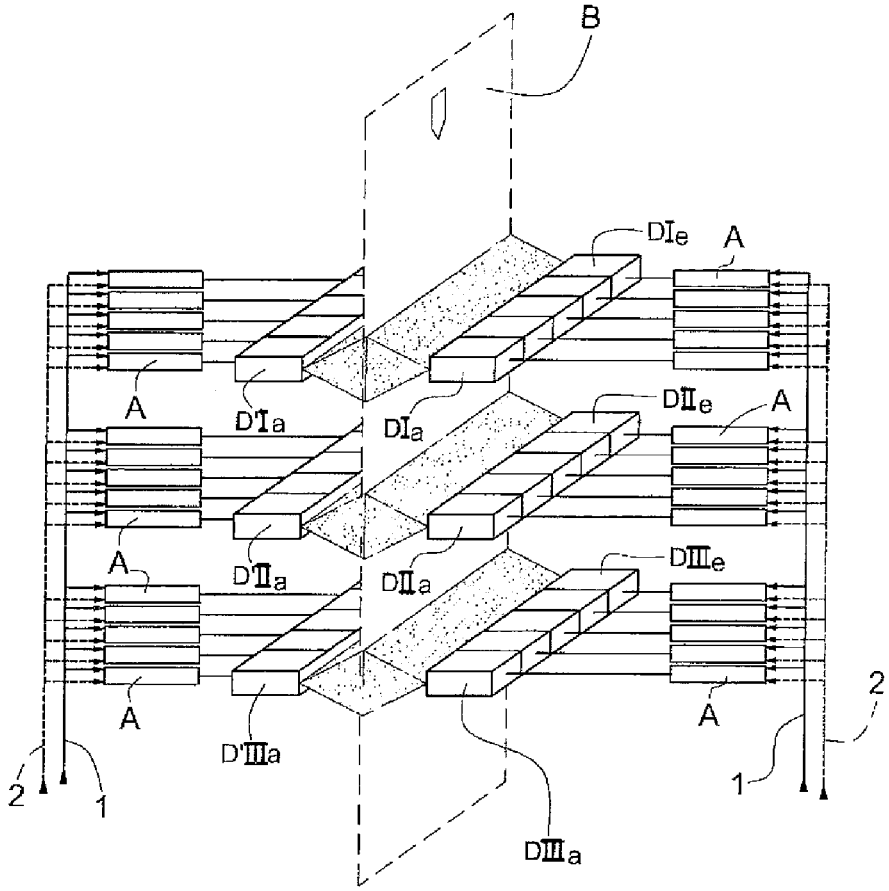
FIG. 4 is a diagram, similar to FIG. 3, of an alternative embodiment with cooling units split up over the width and length of the strip.

As shown in FIG. 4, this transverse regulation of the temperature of the cooling liquid can be implemented over the length of the strip so as to obtain more flexible regulation by adjusting the cooling parameters of the strip at all points of the cooling section.

The invention also relates to a cooling method such that the cooling curve is the target curve at each point of the width of the strip along the cooling section.

The adjustment of the temperature of the water also makes it possible to limit the risk of folds forming (cool buckle) at the beginning of the cooling. This risk may result from a large discontinuity in the slope in the thermal path of the strip when it passes from the heating section, or the temperature maintaining section, to the rapid cooling section. The patent FR 2802552 (or the U.S. Pat. No. 6,464,808) describes this problem in more detail.

By increasing the temperature of the water at the very beginning of the cooling, for example to 80° C., the invention makes it possible to limit the initial cooling of the strip and hence limits the risk of the formation of folds (cool buckle) as a result of a smaller discontinuity in the slope.

The invention thus also relates to a method for controlling the cooling of a moving metal strip in a continuous processing line which sprays onto the strip a liquid or a mixture consisting of a gas and a liquid, with the temperature of the liquid adjusted at the beginning of the cooling so as to limit the variation in the temperature slope resulting from the cooling, compared with heating or maintaining at the previous temperature.

For a same flow rate of cooling liquid, increasing its temperature according to the invention, for example from 40° C. to 60° C., enables cooling with smaller flows, which allows cycles with smaller cooling slopes, allowing increased flexibility of the cooling section.

The combined adjustment of the temperature and the flow rate of the cooling liquid makes it possible to modulate the thermal flow extracted from the strip.

According to the invention, as illustrated in FIG. 4, the temperature and the flow rate of the cooling liquid are adjusted over the width and the length of the strip, so as to increase the flexibility of the plant by benefiting from a wider range within which the speed of the cooling of the strip is adjusted. The cooling units are split up widthwise (letter suffixes a, . . . e) and lengthwise (Roman numeral suffixes I, II, III) into individual units DIa, . . . DIIIe.

Also according to the invention, controlling the temperature profile over the width of the strip resulting from the adjustment of the cooling capacity over the width of the strip makes it possible to improve the guidance of the strip over the transporting rollers by the creation of long or short edges relative to the center of the strip.

Controlling the temperature profile over the width of the strip resulting from the adjustment of the cooling capacity over the width of the strip makes it possible to improve the flatness of the strip by controlling the length of the edges relative to the center of the strip.

Controlling the temperature profile over the width of the strip resulting from the adjustment of the cooling capacity over the width of the strip makes it possible to improve the stability of the strip by controlling the length of the edges relative to the center of the strip.

Advantageously, the adjustment of the cooling capacity over the length of the cooling section and over the width of the strip is carried out in real time by a control and command system (not shown) of the line by means of a calculator using mathematical models which take into account the progression of the heat exchange between the strip and its environment in the cooling section and in the section situated downstream therefrom. The calculator commands the regulating valves CV1, CV2 of the different systems A.

The invention also consists in splitting the cooling device up both across the width and along the length of the strip into a plurality of units, as illustrated in FIG. 4. Each unit is equipped with the equipment required to vary the temperature and the flow rate of the cooling liquid and/or the atomization parameters, independently of the other units.

The size of the cooling units DI . . . DIII can differ along the cooling section with a smaller size in the portion of the cooling section where the calefaction phenomenon may become unstable so as to better control the phenomenon. In this portion, the length of the cooling units can be smaller in the direction in which the strip moves. The width of the cooling units can also be reduced there, relative to the width of the strip.

In the case of cooling using a mixture consisting of a gas and a liquid, each unit can be equipped with two control means which make it possible to vary the flow rate of gas and the flow rate of the liquid.

Each unit can also be equipped with a device which makes it possible to vary the temperature of the gas, the liquid or the mixture consisting of the gas and the liquid so as to affect the calefaction phenomenon and vary the cooling capacity. This variation of the temperature of the cooling medium can be achieved for a constant flow rate of the cooling medium or combined with a variation of the flow rate of the cooling medium so as to increase the regulating flexibility of the plant.

The production capacity of a continuous line varies within large proportions depending on the size of the strip, in particular its thickness, and depending on the thermal cycle.

Depending on the production level, the flow rate of sprayed water will thus vary greatly, which makes it difficult to control for the large and small flow rates owing to the limited flexibility of the means for controlling the flow rate. In order to increase the precision with which the flow rate of water is regulated, the invention also consists in varying the temperature of the cooling liquid so as to limit the amplitude of variation of the flow rate of water.

Thus, according to the invention, for large-scale production necessitating very large cooling flows, cold water will be atomized so as to limit the flow rate of water, but for small-scale production, for example small thicknesses, slightly hotter water will be atomized so as to raise the necessary flow rate of water a little.

The invention thus also relates to a method for controlling the cooling of a moving metal strip in a continuous processing line which sprays the strip with a liquid or a mixture consisting of a gas and a liquid with a temperature of the liquid which is adjusted according to the target cooling capacity so as to limit the variations in the flow rate of the cooling liquid.

Figure 5:
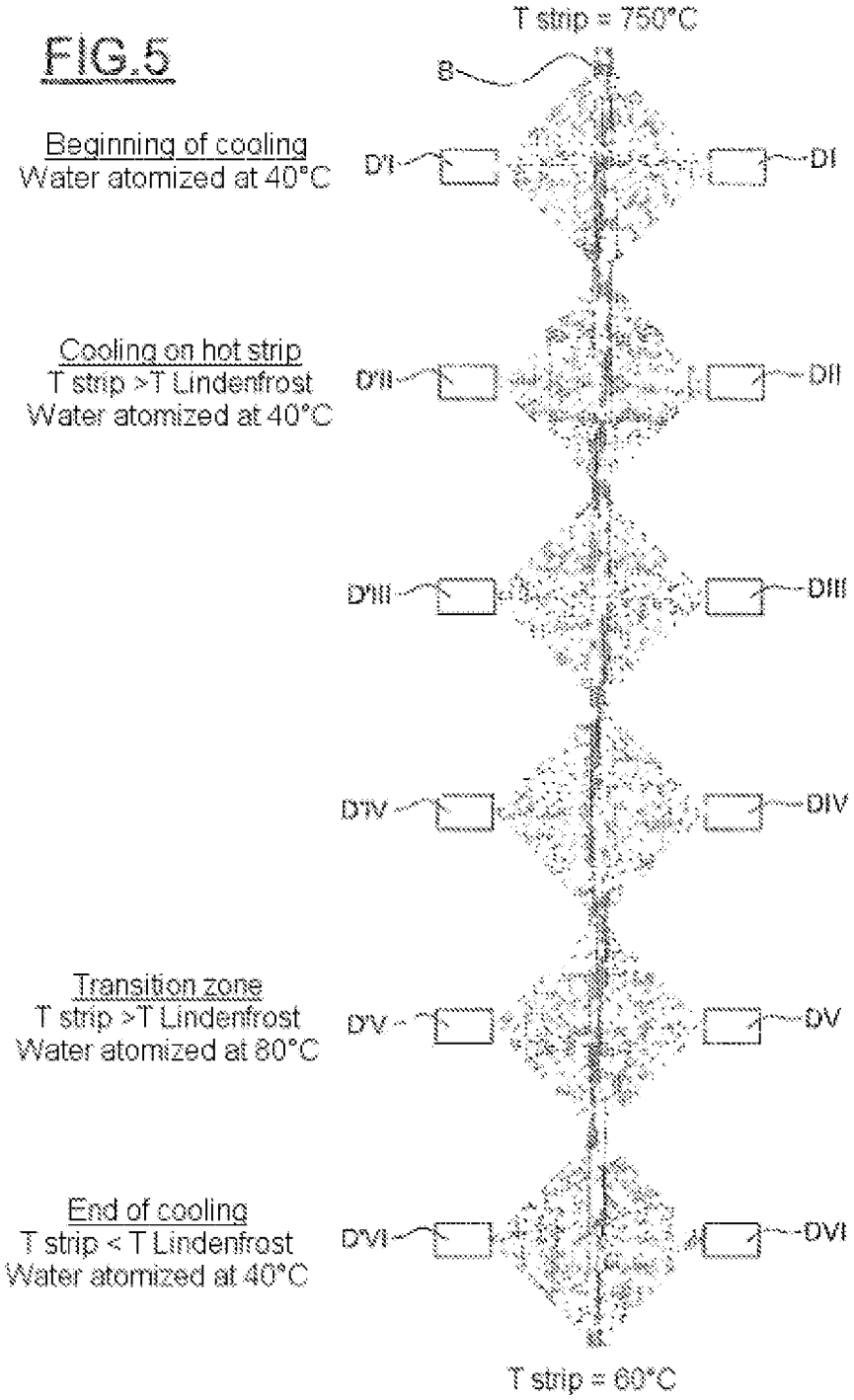
FIG. 5 is a diagrammatic vertical section of an example of a cooling section.

An exemplary embodiment, depicted in FIG. 5 and summarized below, creates the variations in the temperature of the cooling water according to the invention:

- at the beginning of the cooling (zone DI, D'I), the metal strip is at 750° C. and the atomized water is at 80° C. so as to limit the risk of folds forming on the strip (cool buckle),
- the atomized water is then at 40° C. so as to obtain a rapid cooling throughout the zone (DII, DIII, DIV; D'II, D'III, D'IV) where the temperature of the strip is significantly greater than the Lindenfrost temperature,
- and then, in the critical zone (DV, DV') or transition zone where the temperature of the strip is close to the Lindenfrost temperature, the temperature of the water is brought to 80° C. so as to preserve a vapor film for as long as possible.
- and finally, in the zone (DVI, D'VI) where the temperature of the strip is below the Lindenfrost temperature, the temperature of the water is returned to 40° C. so as to rapidly reach the required temperature of the strip (60° C.) at the end of the cooling.

The invention claimed is:

1. A method for controlling the cooling of a vertically moving metal strip in a cooling section of a continuous processing line which sprays in a plurality of spray zones onto the strip a liquid or a mixture consisting of a gas and a liquid, the cooling being dependent on cooling parameters including the temperature, speed and characteristics of the stream of cooling liquid, the method comprising:

controlling the cooling parameters in a plurality of spray zones such that a vapor film is maintained at the surface of the hot strip, controlling a cooling capacity across the plurality of spray zones by adjusting one or more of the cooling parameters in one or more of the spray zones while maintaining the vapor film at the surface of the strip in each spray zone, wherein successive ones of the spray zones are arranged in the direction in which the strip moves, wherein a first cooling capacity in a first of the successive ones of the spray zones is controlled to be different than a second cooling capacity in a second of the successive ones of the spray zones, and adjacent ones of the spray zones are distributed over a width of the strip, wherein the temperature of the cooling liquid for each adjacent one of the spraying zones is adjusted over the width of the strip.

2. The method as claimed in claim 1, wherein, as one of the cooling parameters, an atomization parameter is adjusted which is formed by at least one of the velocity of the cooling liquid and the diameter of droplets of cooling liquid.

3. The cooling method as claimed in claim 1, wherein a combined adjustment of the temperature and the flow rate of the cooling liquid is carried out so as to enable the heat flow extracted from the strip to be modulated in one or more of the spray zones.

4. The cooling method as claimed in claim 1, wherein the flow rate of the cooling liquid for each adjacent one of the spray zones is adjusted over the width of the strip to control the cooling capacity over the width of the strip.

5. The method as claimed in claim 1, wherein the temperature of the liquid is adjusted at the beginning of the cooling so as to limit the variation in the temperature slope resulting from cooling, compared with heating or compared with maintaining the preceding temperature.

6. The method as claimed in claim 1, wherein the temperature of the liquid is adjusted according to a target cooling capacity so as to limit the variations in the flow rate of the cooling liquid.

7. The method as claimed in claim 1, wherein, in order to control the cooling parameters in the plurality of spray zones to maintain the vapor film at the surface of the hot strip, prior tests are carried out during which:

the operating conditions are varied, it is observed when redampening of the strip occurs due to localized disappearance of the vapor film and in which of the spray zones, and, all other operating conditions being unaltered, the temperature of the liquid is gradually raised in the spray zone where the redampening occurs so as to be able to define the liquid temperature required to eliminate the redampening and restore the vapor film.

8. The method as claimed in claim 7, wherein the tests are repeated in a following spray zone, in the direction in which the strip moves, so as to preserve the vapor film throughout the cooling section or, when that is not possible, to defer the beginning of the redampening to a lower temperature.

9. The method as claimed in claim 7 wherein, in order to define the point in time at which the redampening occurs and the spray zone in which it occurs, the appearance of a steep increase in the transverse temperature gradient of the strip, and of a significant discontinuity in the cooling slope resulting from the more intense cooling with no vapor film present, is determined with the aid of devices for measuring the temperature of the strip in the spray, zones where the redampening is likely to occur.

10. The method as claimed in claim 7, wherein the tests are carried out in one of the spray zones situated along the edge of the metal strip where the temperature of the strip is between 450° C. and 250° C., and at several points over the width of the strip so as to detect large variations in temperature.

11. A cooling section of a continuous processing line for implementing a method as claimed in claim 1, the cooling section comprising a plurality of units for spraying the vertically moving metal strip with the cooling liquid, the units forming the successive ones of the spray zones and the adjacent ones of the spray zones, the cooling section further comprising, for at least one of the units, a system for supplying cooling liquid which comprises two separate circuits for supplying cold water and hot water, each being equipped with a regulating valve and connected to a same outlet duct, a controller for the flow rate of the mixture being provided on the outlet duct, as well as a controller for the temperature of the mixture.

12. The cooling section as claimed in claim 11, wherein the supply system has a regulator which makes it possible to adjust the proportion of the flow rates of cold water and hot water so as to obtain the overall target flow rate of the liquid at the desired temperature, and this is the case for each spraying device.

* * * * *